United States Patent [19]

Boella et al.

[11] Patent Number: 4,630,949

[45] Date of Patent: Dec. 23, 1986

[54] DEVICE FOR CONTROLLING THE ROTARY MOVEMENT OF A PLATEN

[75] Inventors: Marcello Boella, Loranzè; Ugo Carena, Ivrea, both of Italy

[73] Assignee: Ing C. Olivetti & C., S.p.A., Ivrea, Italy

[21] Appl. No.: 649,491

[22] Filed: Sep. 11, 1984

[30] Foreign Application Priority Data

Sep. 12, 1983 [IT] Italy ..... 67938 A/83

[51] Int. Cl.[4] ..... B41J 19/92

[52] U.S. Cl. ..... 400/568; 400/551; 400/569; 200/11 J; 200/11 K; 200/11 TW; 200/153 K

[58] Field of Search ..... 400/71, 479, 545, 549, 400/551, 568, 569, 550; 200/11 K, 17 R, 153 K, 11 R, 11 A, 11 DA, 11 J, 11 TW, 153 R, 153 D, 153 N, 153 P

[56] References Cited

U.S. PATENT DOCUMENTS

| | | | |
|---|---|---|---|
| 1,539,521 | 5/1925 | Smith | 400/569 |
| 2,008,053 | 7/1935 | Whiteside | 200/11 J |
| 3,754,106 | 8/1973 | MacDonald | 200/11 DA |
| 4,135,065 | 1/1979 | Nicot | 200/11 DA |
| 4,405,248 | 9/1983 | Wunderlich et al. | 400/551 |

FOREIGN PATENT DOCUMENTS

| | | | |
|---|---|---|---|
| 16912 | 10/1980 | European Pat. Off. | 400/479 |
| 2943493 | 8/1980 | Fed. Rep. of Germany | 400/568 |

OTHER PUBLICATIONS

Garrison et al; "Automated Platen Vernier Switch"; *IBM Technical Disclosure Bulletin;* vol. 22, No. 5, pp. 1760–1763; Oct. 1979.

Holcomb et al; "Simulated Platen Knobs for Typewriters"; *IBM Technical Disclosure Bulletin;* vol. 24, No. 12, pp. 6532–6533; May 1982.

*Primary Examiner*—Edgar S. Burr
*Assistant Examiner*—David A. Wiecking
*Attorney, Agent, or Firm*—Banner, Birch, McKie & Beckett

[57] ABSTRACT

A device for controlling the rotary movement of a platen roller of a typewriter comprises a bidirectional electric motor coupled to the platen by a worm gear and gear wheel and a pair of knobs which are disposed at the sides of the platen and which are rotatable with respect thereto. The knobs are fixed to a bar which extends rotatably through the platen roller and carries the gear wheel. Selective bidirectional rotation of the knobs causes corresponding rotary movement of a disc in a transducer. The disc has a toothed sector in mesh with the gear wheel and is the moving part of a rotary switch which generates electrical signals which determine both the power supply to the electric motor and the direction of rotation thereof. Small degrees of rotary movement of the knobs against a first spring force establish continuous rotary movement of the platen roller at low speed. A further slight rotary movement of the knobs against a stronger spring force establishes rotary movement of the platen at high speed.

10 Claims, 4 Drawing Figures

DEVICE FOR CONTROLLING THE ROTARY MOVEMENT OF A PLATEN

BACKGROUND OF THE INVENTION

The present invention relates to a device for controlling the rotary movement of a platen roller of a typewriter or any other office printing machine.

Normally, the rotary movement of the platen roller that is required for precisely positioning a sheet with respect to the line of typing of the printing arrangement, including in machines which are provided with electrical line spacing arrangements, is effected manually by operating side knobs which are coaxial with respect to the roller. The knobs are usually also provided with a clutch which releases the roller from the line spacing mechanism so that the manual rotary movements can be independent of the preset elementary line spacing value, for effecting micrometric positioning of the sheet of paper.

SUMMARY OF THE INVENTION

The object of the present invention is to provide a device which is low in cost and simple to use and which is capable of controlling the rotary movement of a platen roller, with a high degree of accuracy.

This object is met in a simple and reliable manner by the device according to the invention which comprises an electric motor connected to the roller and at least one knob which is mounted rotatably with respect to a fixed part, and is characterised by a transducer which co-operates with the knob to cause the supply of power to the electric motor when the knob rotates with respect to the fixed part.

BRIEF DESCRIPTION OF THE DRAWING

The invention will be described in more detail, by way of example, with reference to the accompanying drawings in which.

DETAILED DESCRIPTION

Figure 1:
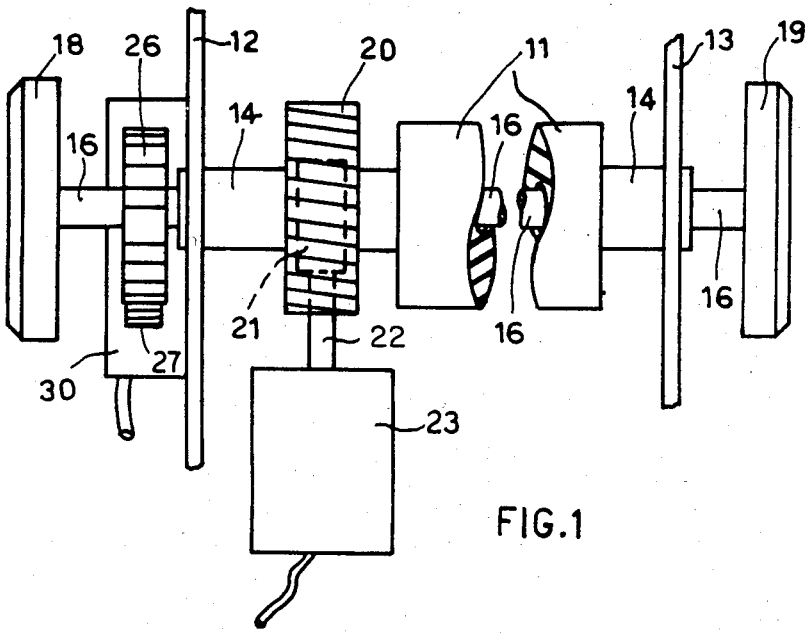
FIG. 1 is a diagrammatic front view of a device according to the invention.

With reference to FIG. 1, a device 10 according to the invention is shown applied to an office machine having a platen roller 11 which is mounted, by means of its central shaft 14, rotatably on two fixed side plates 12 and 13 of the machine.

Figure 2:
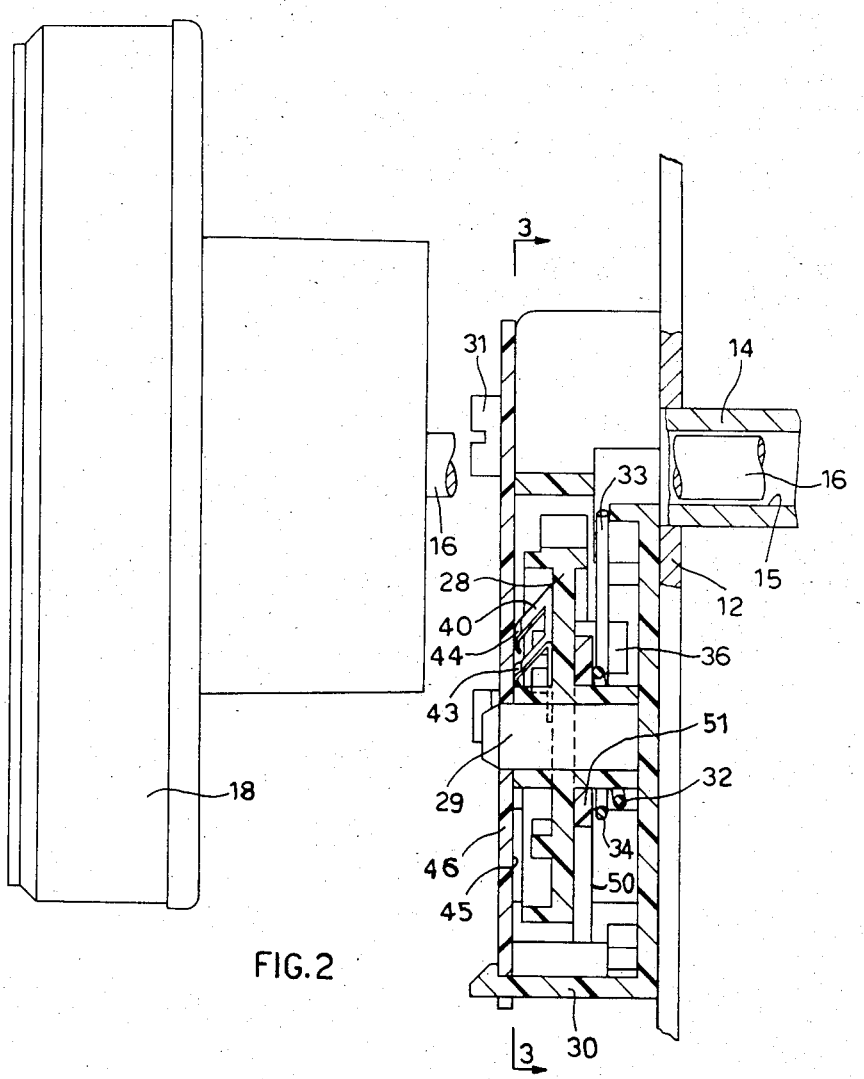
FIG. 2 is a view in partial section on an enlarged scale of a detail of the device shown in FIG. 1.

The shaft 14 of the platen 11 is hollow, providing a cylindrical passage 15 (see FIG. 2), within which a cylindrical bar 16 which is free to rotate is coaxially housed. Two knobs 18 and 19 (see FIG. 1) are fixed to the two ends of the cylindrical bar 16, outside the side plates 12 and 13. Suitable guide means (not shown) support the bar 16 with respect to the side plates and prevent axial displacement of the bar.

Keyed on to the shaft 14 is a gear wheel 20 which is in constant mesh with a worm 21 which is fixed to the upper end of a shaft 22 of a bidirectional electric motor 23, for example of direct current type.

Keyed on to the bar 16 is a gear wheel 26 (see FIGS. 1 and 3) which is in constant mesh with a toothed sector 27 of a disc 28 which is mounted rotatably on a pin 29 within a cylindrical casing 30 fixed to the side plate 12 by a screw 31.

Figure 3:
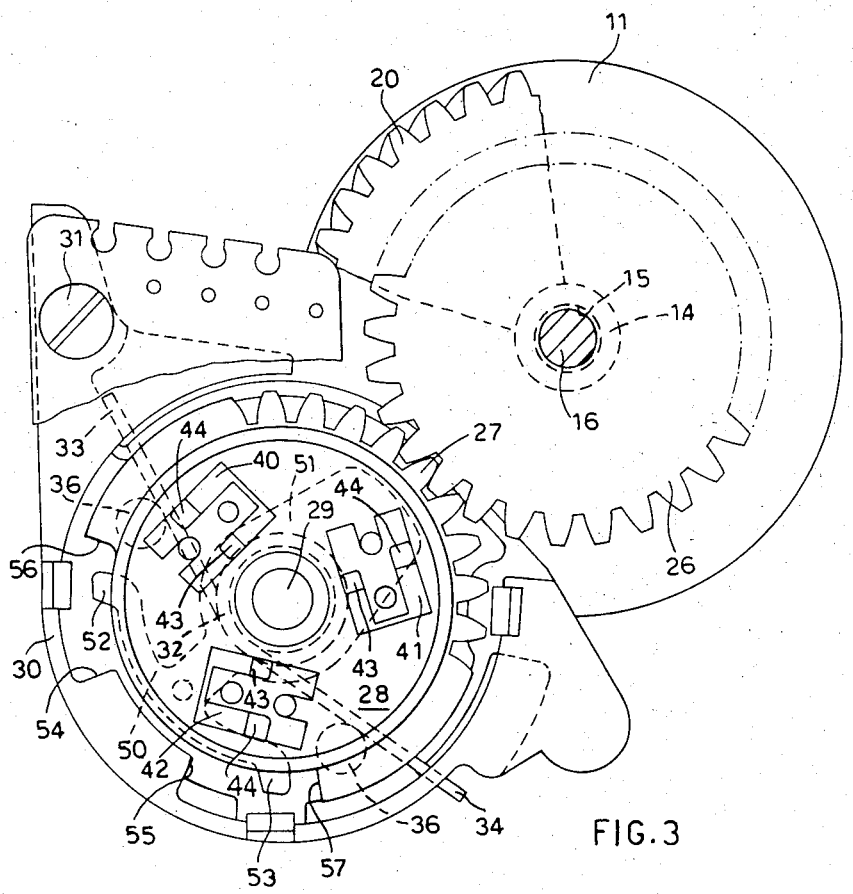
FIG. 3 is a view in section taken along line 3—3 in FIG. 2.

A spring 32 which is partially coiled around the pin 29 has two arms 33 and 34 which bear against two pegs 35 and 36 respectively on the disc 28 and hold the disc in a rest position as shown in FIG. 3.

Fixed on the disc 28, on the opposite side with respect to the spring 32, are three metal blades 40, 41 and 42 which are disposed at 120° relative to each other and which are equally spaced from the pin 29. Each metal blade 40, 41 and 42 is so shaped as to provide a pair of arms 43 and 44 which are constantly in contact with the conductor paths of a printed circuit 45 provided on the internal part of a cover 46 of the casing 30 (see FIGS. 2 and 4). The printed circuit 45 will be described in detail hereinafter and represents a transducer signalling the position of the knobs 18 and 19.

A resilient element 50 (see FIGS. 2 and 3), disposed between the disc 28 and the spring 32, has a central portion 51 which is fixed with respect to the disc 28, and is provided with two lateral flexible teeth 52 and 53 capable of co-operating with two shoulders 54 and 55 respectively of the casing 30. The disc 28 is also provided with two abutments 56 and 57 co-operable with the shoulders 54 and 55 respectively, to limit the rotary movement of the disc.

The printed circuit 45 (see FIG. 4) comprises four conductor paths 60, 61, 62 and 63 which are of such a configuration as to define a central path 61 and three external paths 60, 62 and 63.

The three metal blades 40, 41 and 42 are so disposed that the arms 43 thereof are always in contact with the central path 61, while the outside arms 42 are capable of selectively contacting the external paths 60, 62 and 63 to generate electrical signals and control the motor 23, as will be described in greater detail hereinafter.

Figure 4:
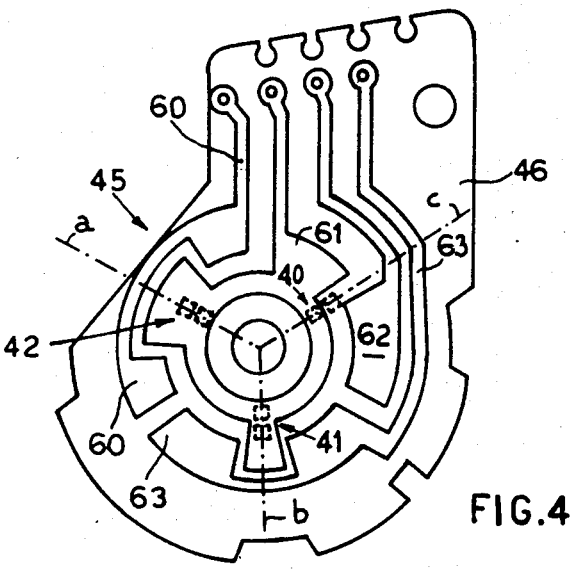
FIG. 4 is a front view of an element of the device shown in FIG. 1.

In the rest position, the arms 42 and 43 of the blades 40, 41 and 42 are disposed along the radii a, b and c respectively in FIG. 4.

The mode of operation of the apparatus described hereinbefore is as follows.

In the rest condition, the spring 32 holds the disc 28 and the associated blades 40, 41 and 42 in the position shown in the drawings. Since, in that position, none of the arms 44 touches the outside paths 60, 62 and 63, no contact is closed, the motor 23 is not powered and the platen 11 remains stationary.

To control rotary movement of the platen roller 11 in one of the two directions, for example for the purpose of positioning a sheet of paper with respect to the printing arrangement of the machine (not shown), it is sufficient manually to rotate the knobs 18 and 19 by a few degrees, in the direction in question, independently of the magnitude of the rotary movement which is to be imparted to the roller.

Let is be assumed for example that the roller 11 is to be rotated in the clockwise direction in FIG. 3. The knob 18 and/or 19 is rotated in a clockwise direction through at least 15°, that is to say, until the arm 44 of the blade 41 is brought into contact with the external path 63 (see FIG. 4), thus generating an electrical signal which in known manner causes the supply of power to the electrical motor 23 at low speed in a direction such as to rotate the roller 11 in a clockwise direction. The direction of rotation of the motor 23 is determined by another electrical signal which is generated by the blade 40 being or not being in contact with the path 62. If the knob 18 is rotated in a clockwise direction (see FIG. 3), the disc 28 rotates in an anticlockwise direction and moves the blade 40 into a position against the path 62, thus forming electrical contact between the central path 61 and the external path 62 while if the knob 18 is rotated in the anticlockwise direction, the disc 28 rotates in the clockwise direction and moves the blade 40 and in particular the arm 44 thereof only into contact with the central path 61.

As can be seen from FIG. 4, only a few degrees of rotary movement of the disc 28 determines the direction of rotation of the motor 23, with contact being made or not made between the path 62 and the path 61 and, after about 15°, irrespective of the direction of rotation, contact is made between the central path 61 and the external path 63.

The speed of rotation of the motor is then low, which can easily provide for micrometric positioning of the sheet carried by the roller 11.

After a rotary movement of the disc 28 of about 30°, in one direction or the other, the tooth 52 or 53 of the resilient element 50 comes to bear against the shoulder 54 or 55 respectively of the casing 30, giving the operator a sensation of physical resistance to continuing with the rotary movement of the knob 18 and/or 19.

If the operator continues with the rotary movement, overcoming that slight resistance, the tooth 52 or 53 flexes and the blade 42 which, hitherto, had only touched the central path 61, forms a contact between the path 61 and the external path 60. The consequential electrical signal which is generated causes rotary movement of the motor 23 at a higher speed.

The rotary movement of the knobs 18 and 19 and the disc 28 is stopped when one of the two abutments 56 and 57 on the disc comes into contact with the shoulder 54 or 55 respectively of the casing 30.

To stop the rotary movement of the roller 11, it is sufficient to let the knobs 18 and 19 return to their rest position, under the action of the spring 32.

The electrical signals which are produced by closure of the contacts between the paths of the printed circuit 45 are processed in known manner by the control unit of the machine to which the device according to the invention is fitted. For example, they may be recognised as input signals alternative to those generated by an electrical keyboard providing keys for directly controlling the rotary movement of the platen roller.

The above-described device is applied to various types of electric motors, including those of the stepping type. The associated actuating circuitry may also be of any known type. Such circuitry will however be capable of rotating the motor in such a way as to move the paper carried by the roller 11 by a distance of the order of 0.1 mm, when the cycle of rotation and return to the rest position of the knob, which is performed by the operator, is very short.

Particular advantages are also achieved by using the motor positioning circuit described in our published European patent application No. 0 102 248, issuing as U.S. Pat. No. 4,605,887 on Aug. 12, 1986.

What we claim is:

1. In a device for controlling the rotary movement of a platen comprising a frame having two side plates for rotatably supporting said platen, an electric motor coupled to said platen, a knob rotatably mounted on said frame, and transducer means having a fixed portion and a movable portion, wherein said movable portion is operatively connected with said knob and cooperates with said fixed portion for generating signals indicative of the rotation of said knob and wherein control means respond to said signals to drive said motor in accordance with the rotation of said knob, wherein said electric motor is of bidirectional type and said signals are dependent on the direction of rotation of said movable portion, and wherein the direction of rotation of said electric motor is determined by the direction of rotation of said rotating member, the combination comprising:

a rotating member carrying the movable portion of said transducer means;

a support member for rotatably supporting said rotating member around a given axis; and a spring member having an intermediate portion partially coiled around said axis and two end portions cooperative with two pegs fixed to said rotating member for urging said rotating member toward a rest position;

wherein said knob is fixed coaxially with a gear wheel, wherein said rotating member comprises a toothed sector engageable with said gear wheel and wherein said support member comprises a casing fixed to one of said two side plates adjacent to said platen;

wherein said motor can rotate at two different speeds, and wherein a lower speed and a higher speed are determined by lower rotations and higher rotations of said movable portion, further comprising second resilient means for establishing on said rotating member an opposing force greater than the force of said spring member as said knob rotates said movable portion through said higher rotations to select the higher of said two speeds.

2. A device according to claim 1, wherein said second resilient means comprise a flexible member having a central portion fixed to said movable portion and having two opposite flexible projecting ends at opposite sides of said central portion, wherein said supporting member comprises two shoulders associated with said flexible arms, and wherein one or another of said flexible arms cooperates with one or another of said two shoulders for establishing said second opposing force as said knob rotates the movable portion of said transducer through said higher rotations.

3. A device according to claim 2, wherein the fixed portion of said transducer means comprises a printed circuit board having a common conductive path and three different conductive paths, wherein a first path has a single portion associated with one of said two opposite senses of rotation of said movable portion, a second path has two portions associated with the two opposite senses of rotation and the lower rotations of said movable portion and a third path has two portions associated with the two opposite senses of rotation and the higher rotations of said movable portion and wherein said movable portion comprises three movable contacts each having two arms, wherein one of said arms is permanently in contact with said common conductive path and wherein the other arm of the first movable contact is carried in contact with said first path upon a rotation of said movable portion along said one of said two senses of rotation, the other arm of the second movable contact is carried in contact with said second path upon the lowest rotation of said movable portion and the other arm of the third movable contact is carried in contact with said third path jointly with the engagement of the one or the other of said flexible arms with the one or the other of said two shoulders.

4. A device according to claim 3, wherein said three movable contacts are disposed at 120° relative to each other, and wherein the movable portion of said transducer means carries two stop elements, each adjacent to a free end of said flexible arms and cooperative with said shoulders to delimit the end of movement of said movable portion.

5. A device for controlling the rotary movement of a platen comprising a frame, an electric motor coupled to said platen, a knob rotatably mounted on said frame, transducer means having a fixed portion and a movable portion, wherein said movable portion is operatively connected with said knob and cooperates with said fixed portion for generating signals indicative of the rotation of said knob, control means responsive to said signals to drive said motor in accordance with the rotation of the said knob;

wherein said electric motor is of bidirectional type and the movable portion of said transducer means is rotatable by said knob from a rest position along two opposite senses of rotation to generate associated signals determining the sense of rotation of said motor, wherein said motor can rotate at two different speeds, and wherein a lower speed and a higher speed are determined by lower rotations and higher rotations of the movable portion of said transducer means, respectively;

wherein the fixed portion of said transducer means comprises a printed circuit board comprising a common conductive annular path and three different conductive paths, wherein a first path has a single portion associated with one of said two opposite senses of rotation of said movable portion, a second path has two portions associated with the two opposite senses of rotation and the lower rotations of said movable portion and a third path has two portions associated with the two opposite senses of rotation and the higher rotations of said movable portion;

wherein the movable portion of said transducer means comprises three spring mounted movable contacts angularly spaced on said movable portion and each having two arms wherein one of said arms is spring held in contact with a different portion of said common annular path, the other arm of the first movable contact is spring carried in contact with said first path upon a rotation of said movable portion along said one of said two senses of rotation, the other arm of the second movable contact is spring carried in contact with said second path upon the lower rotations of said movable portion and the other arm of the third movable contact is spring carried in contact with said third path upon the higher rotations of the movable portion of said tranducer means;

wherein first resilient means are provided for establishing a first opposing force for urging said movable portion and said knob toward their rest position wherein said three movable contacts are of identical shape and are disposed at 120° relative to each other, further comprising stop means to limit the rotation of said movable part; and second resilient means for establishing a second opposite force greater than said first opposing force jointly with the contact of the other arm of the third movable contact with said third path.

6. In a device for controlling the rotary movement of a platen comprising a frame, an electric motor coupled to said platen, a knob rotatably mounted on said frame, a bar member lodged with clearance into a through hole of said platen and having coaxially fixed on one end said knob which is freely rotatable with respect to said platen; a gear wheel fixed to said bar member adjacent to said one knob; and transducer means having a fixed portion and a movable portion, wherein said movable portion is operatively connected with said knob and cooperates with said fixed portion for generating signals indicative of the rotation of said knob and wherein control means respond to said signals to drive said motor in accordance with the rotation of said knob, the combination comprising:

two side plates of said frame for rotatably supporting said platen;

a toothed member engageable with said gear wheel and driving the movable portion of said transducer means; g a casing mounting the fixed portion of said transducer means and rotatably supporting said toothed member;

means for fixing said casing on one of said two side plates adjacent to said knob; wherein said electric motor is of bidirectional type and the movable portion of said transducer means is rotated by said knob from a rest position along two opposite senses of rotation to generate associated signals determining the sense of rotation of said motor, wherein said motor can rotate at two different speeds, and wherein a lower speed and a higher speed are determined by lower rotations and higher rotations of the movable portion of said transducer means, respectively;

first resilient means for establishing a first opposing force for holding said knob in a rest position; and second resilient means for establishing a second opposing force greater than said first opposing force as said knob rotates said movable portion through said higher rotations to select the higher of said two speeds;

wherein said second resilient means comprise a flexible member having a central portion fixed to said movable portion and having two opposite flexible arms projecting at opposite sides of said central portion, wherein said casing comprises two shoulders associated with said flexible arms, and wherein one or another of said flexible arms cooperates with one or another of said two shoulders for establishing said second opposing force as said knob rotates the movable portion of said transducer through said higher rotations.

7. A device according to claim 6, further comprising a second knob keyed on to the opposite end of said bar member.

8. A device according to claim 6, wherein the fixed portion of said transducer means comprises a printed circuit board fixed to said casing and comprising a commond conductive path and three different conductive paths wherein a first path has a single portion associated with one of said two opposite senses of rotation of said movable portion, a second path has two portions associated with the two opposite senses of rotation and the lower rotations of said movable portion and a third path has two portions associated with the two opposite senses of rotation and the higher rotations of said movable portion, and wherein said movable portion comprises three movable contacts each having two arms wherein one of said two arms of each movable contact is permanently in contact with a different portion of said common conductive path and wherein the other arm of the first movable contact is carried in contact with said first path upon a rotation of said movable portion along said one of said two senses of rotation, the other arm of the second movable contact is carried in contact with said second path upon the lowest rotation of said movable portion and the other arm of the third movable contact is carried in contact with said third path upon the higher rotations of the movable portion of said transducer means.

9. A device according to claim 8, wherein said three movable contacts are of identical shape and are disposed at 120° relative to each other, further comprising stop means to limit the rotation of said movable part.

10. A device according to claim 6, wherein the fixed portion of said transducer means comprises a printed circuit board, fixed to said casing, comprising a common conductive path and three different conductive paths, wherein a first path includes a single portion associated with one of said two opposite senses of rotation of said movable portion, a second path includes two portions associated with the two opposite senses of rotation and the lower rotations of said movable portions and a third path includes two portions associated with the two opposite senses of rotation and the higher rotations of said movable portion, and wherein the movable portion of said transducer means comprises three movable contacts to selectively contact said common conductive path, and one of said first, second and third paths in dependence on the sense of rotation and said lower or higher rotations of said movable portion, wherein said movable contact are carried by a first surface of said toothed member facing said printed circuit board, wherein said toothed member comprises a second surface opposite to said first surface and carrying two pins projecting therefrom, wherein said first resilient means comprise a spring member interposed between the second surface of said toothed member and said casing and having an intermediate coil partially wound around in axis of said toothed member and two end portions cooperative with said casing and with said two pins and wherein the central portion of said flexible member is fixed to the second surface of said toothed member.

* * * * *